US011819726B2

(12) United States Patent
Chen

(10) Patent No.: US 11,819,726 B2
(45) Date of Patent: Nov. 21, 2023

(54) ADJUSTABLE EXERCISE DEVICE

(71) Applicant: Floriey Industries International Co., Taichung (TW)

(72) Inventor: Paul Chen, Taichung (TW)

(73) Assignee: FLORIEY INDUSTRIES INTERNATIONAL CO., Taichung (TW)

( * ) Notice: Subject to any disclaimer, the term of this patent is extended or adjusted under 35 U.S.C. 154(b) by 237 days.

(21) Appl. No.: 17/500,675

(22) Filed: Oct. 13, 2021

(65) Prior Publication Data

US 2023/0113430 A1 Apr. 13, 2023

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01)

(58) Field of Classification Search
CPC ..... A63B 21/0726; A63B 71/0036; A63B 21/072–075
See application file for complete search history.

(56) References Cited

U.S. PATENT DOCUMENTS 5,407,413 A 4/1995 Kupferman
5,839,997 A 11/1998 Roth et al.
6,656,093 B2 12/2003 Chen
7,223,214 B2 5/2007 Chen
7,731,641 B1 6/2010 Chen
7,811,213 B2 10/2010 Chen
9,616,273 B2 4/2017 Chen
9,956,451 B1 * 5/2018 Wang ..... A63B 21/4043
10,343,010 B2 7/2019 Chen
10,463,906 B2 * 11/2019 Owusu ..... A63B 24/0087
11,179,594 B2 * 11/2021 Chen ..... A63B 21/0728
2014/0349820 A1 * 11/2014 Wang ..... A63B 21/063 482/108
2020/0114204 A1 * 4/2020 Owusu ..... A63B 24/0087
2021/0154519 A1 * 5/2021 Chen ..... A63B 21/078
2022/0249900 A1 * 8/2022 Yoon ..... A63B 21/0728

* cited by examiner

*Primary Examiner* — Joshua Lee
*Assistant Examiner* — Catrina A Letterman
(74) *Attorney, Agent, or Firm* — Browdy and Neimark, PLLC

(57) ABSTRACT

An adjustable dumbbell device includes a dumbbell having two weight ring supported on a receptacle, a handle having two end housings to be coupled to the weight rings, two weight members engageable into the housing, two spring biased catches engaged in the weight member, two arms coupled to the spring biased catches for moving the spring biased catches into and out of the weight members, a carrier slidably engaged in the receptacle and having a pole and a stud of different height for engaging with the arms and for actuating the arms to disengage the spring biased catches from the weight members, and an actuator moves the carrier relative to the receptacle to control an engagement of the pole and the stud with the arms.

14 Claims, 8 Drawing Sheets

ADJUSTABLE EXERCISE DEVICE

BACKGROUND OF INVENTION

1. Field of the Invention

The present invention relates to an adjustable exercise device, and more particularly to an adjustable barbell, kettle bell, or dumbbell having an improved structure or configuration for easily and quickly coupling the weight members of the dumbbell together and for preventing the weight members of the adjustable dumbbell from being disengaged or separated from each other, and arranged for allowing the weight or the size or the standard of the weight members or of the adjustable exercise device or the adjustable dumbbell to be suitably increased.

2. Description of the Prior Art

Various kinds of typical adjustable barbells, kettle bells, or dumbbells have been developed and provided for conducting various exercise operations, for example, U.S. Pat. No. 5,407,413 to Kupferman, U.S. Pat. No. 5,839,997 to Roth et al., U.S. Pat. No. 6,656,093 to Chen, U.S. Pat. No. 7,223,214 to Chen, U.S. Pat. No. 7,731,641 to Chen, U.S. Pat. No. 7,811,213 to Chen, U.S. Pat. No. 9,616,273 to Chen, and U.S. Pat. No. 10,343,010 to Chen disclose several of the typical adjustable dumbbells each including a number of weight rings or weight members that may be selectively or adjustably secured together for adjusting the weight of the dumbbells.

Normally, in the typical adjustable dumbbells, a single central handle bar is provided to be engaged with or between the weight rings or the weight members, and the weight rings or the weight members are to be disposed and engaged on the end portions of the central handle bar.

When the weight rings or the weight members include a relatively smaller weight, such as a weight less than fifty (50) pounds, for example, the weight rings or the weight members may be solidly and stably engaged on the end portions of the central handle bar.

However, when the weight rings or the weight members include a relatively greater weight, such as a weight greater than sixty or seventy pounds, for example, the weight rings or the weight members may not be solidly and stably engaged on the end portions of the central handle bar, and may have a good chance to be disengaged or separated from the handle bar, or the user may feel that the weight rings or the weight members may not be solidly and stably held and carried with the central handle bar.

The present invention has arisen to mitigate and/or obviate the afore-described disadvantages of the conventional adjustable barbells, kettle bells, or dumbbells.

SUMMARY OF THE INVENTION

The primary objective of the present invention is to provide an adjustable barbell, kettle bell, or dumbbell including an improved structure or configuration for easily and quickly coupling the weight members of the dumbbell together and for preventing the weight members of the adjustable dumbbell from being disengaged or separated from each other.

The other objective of the present invention is to provide an adjustable barbell, kettle bell, or dumbbell arranged for allowing the weight or the size or the standard of the weight members or of the adjustable exercise device or the adjustable dumbbell to be suitably increased.

In accordance with one aspect of the invention, there is provided an adjustable dumbbell comprising a receptacle including a first passage formed in the receptacle, a first dumbbell including a first weight ring and a second weight ring supported on the receptacle, a handle mechanism including a handle bar having a first housing and a second housing to be coupled to the first and the second weight rings selectively, the first and the second housings each including a chamber formed in the first and the second housings respectively, and a protrusion extended into the chamber of each of the first and the second housings respectively, a first and a second weight members supported on the receptacle and engageable into the chamber of the first housing, the first and the second weight members each including a space formed in the first and the second weight members respectively for receiving and engaging with the protrusion of the first housing, two grooves being formed in each of the first and the second weight members and communicating with the space of the first and the second weight members respectively, two spring biased catches slidably engaged in the grooves of each of the first and the second weight members and either extendible into the space of each of the first and the second weight members or engageable in the grooves of each of the first and the second weight members, two arms being engaged in each of the first and the second weight members and coupled to the spring biased catches respectively for moving the spring biased catches into and out of the space of each of the first and the second weight members, a carrier slidably received and engaged in the receptacle, and including a first pole and a first stud extended from the carrier and extendible upwardly through the first passage of the receptacle for engaging with the arms respectively, the first pole being higher than the first stud, the carrier including a cam member having a first and a second seats, at least one spring biasing member disposed in the receptacle and engaged with the carrier for biasing and forcing the first pole and the first stud to engage with the arms and to disengage the spring biased catches from the space of each of the first and the second weight members, and an actuator engageable with the first and the second seats of the cam member for moving the carrier downwardly relative to the receptacle, and to control an engagement of the first pole and the first stud with the arms.

The receptacle includes an upper panel, and the actuator is rotatably connected to the receptacle. The upper panel of the receptacle includes a slot formed in the upper panel, and the actuator includes a projection engaged in the slot of the upper panel for limiting and guiding the actuator to move relative to the receptacle. The receptacle includes a knob secured to the projection for anchoring the actuator to the receptacle.

The first and the second weight members each include two compartments formed in the first and the second weight members and communicating with the grooves of each of the first and the second weight members for receiving and engaging with the arms respectively.

The compartments of each of the first and the second weight members are communicating with each other at a middle opening, the arms of the first and the second weight members each include a first end portion connected to the spring biased catches, and a second end portion engaged in the opening of each of the first and the second weight members.

The receptacle includes a second passage formed in the receptacle, the carrier includes a second pole and a second stud extended from the carrier and extendible upwardly through the second passage of the receptacle, the first dumbbell includes a third and a fourth weight members supported on the receptacle and engageable into the chamber of the second housing, the third and the fourth weight members each include a space formed in the third and the fourth weight members respectively for receiving and engaging with the protrusion of the second housing, two grooves being formed in each of the third and the fourth weight members and communicating with the space of the third and the fourth weight members respectively, two second spring biased catches slidably engaged in the grooves of each of the third and the fourth weight members and either extendible into the space of each of the third and the fourth weight members or engageable in the grooves of each of the third and the fourth weight members, two arms being engaged in each of the third and the fourth weight members and coupled to the spring biased catches for moving the spring biased catches into and out of the space of each of the third and the fourth weight members respectively.

A second dumbbell may further be provided and includes a third weight ring and a fourth weight ring supported on the receptacle, the receptacle includes a third passage formed in the receptacle, a second handle mechanism includes a handle bar having a third housing and a fourth housing to be coupled to the third and the fourth weight rings selectively, the third and the fourth housings each include a chamber formed in the third and the fourth housings respectively, and a protrusion is extended into the chamber of each of the third and the fourth housings respectively, a first and a second weight elements are supported on the receptacle and engageable into the chamber of the third housing, the first and the second weight elements each include a space formed in the first and the second weight elements respectively for receiving and engaging with the protrusion of the third housing, two grooves are formed in each of the first and the second weight elements and communicating with the space of the first and the second weight elements respectively, two second spring biased catches are slidably engaged in the grooves of each of the first and the second weight elements and either extendible into the space of each of the first and the second weight elements or engageable in the grooves of each of the first and the second weight elements, two second arms are engaged in each of the first and the second weight elements and coupled to the second spring biased catches respectively for moving the second spring biased catches into and out of the space of each of the first and the second weight elements, the carrier includes a third pole and a third stud extended from the carrier and extendible upwardly through the third passage of the receptacle for engaging with the second arms respectively, the third pole being higher than the third stud.

The receptacle includes a fourth passage formed in the receptacle, the carrier includes a fourth pole and a fourth stud extended from the carrier and extendible upwardly through the fourth passage of the receptacle, the second dumbbell includes a third and a fourth weight elements supported on the receptacle and engageable into the chamber of the fourth housing, the third and the fourth weight elements each include a space formed in the third and the fourth weight elements respectively for receiving and engaging with the protrusion of the fourth housing, two grooves being formed in each of the third and the fourth weight elements and communicating with the space of the third and the fourth weight elements respectively, two second spring biased catches slidably engaged in the grooves of each of the third and the fourth weight elements and either extendible into the space of each of the third and the fourth weight elements or engageable in the grooves of each of the third and the fourth weight elements, two arms being engaged in each of the third and the fourth weight elements and coupled to the spring biased catches for moving the spring biased catches into and out of the space of each of the third and the fourth weight elements respectively.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
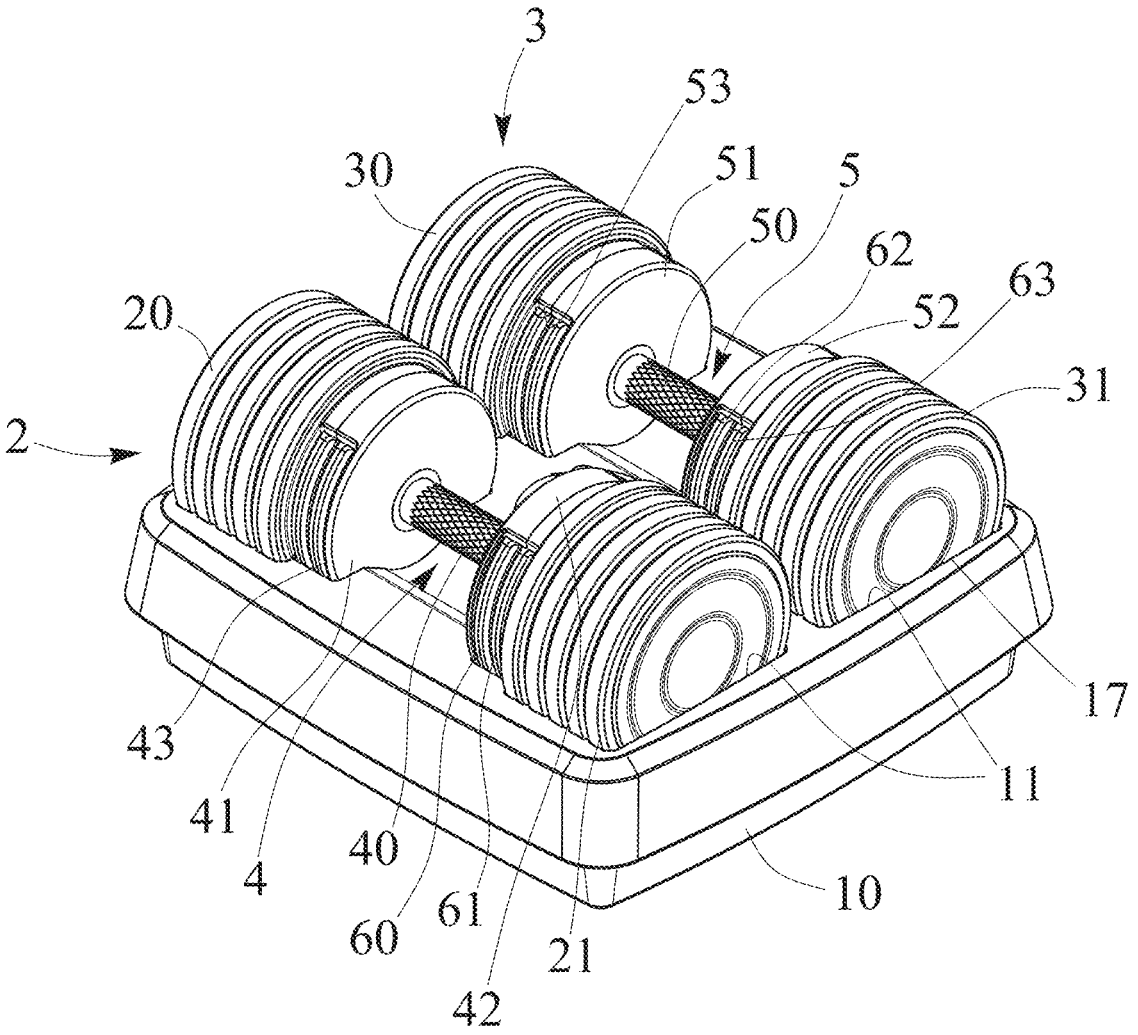
FIG. 1 is a perspective view of an adjustable dumbbell in accordance with the present invention.
Figure 2:
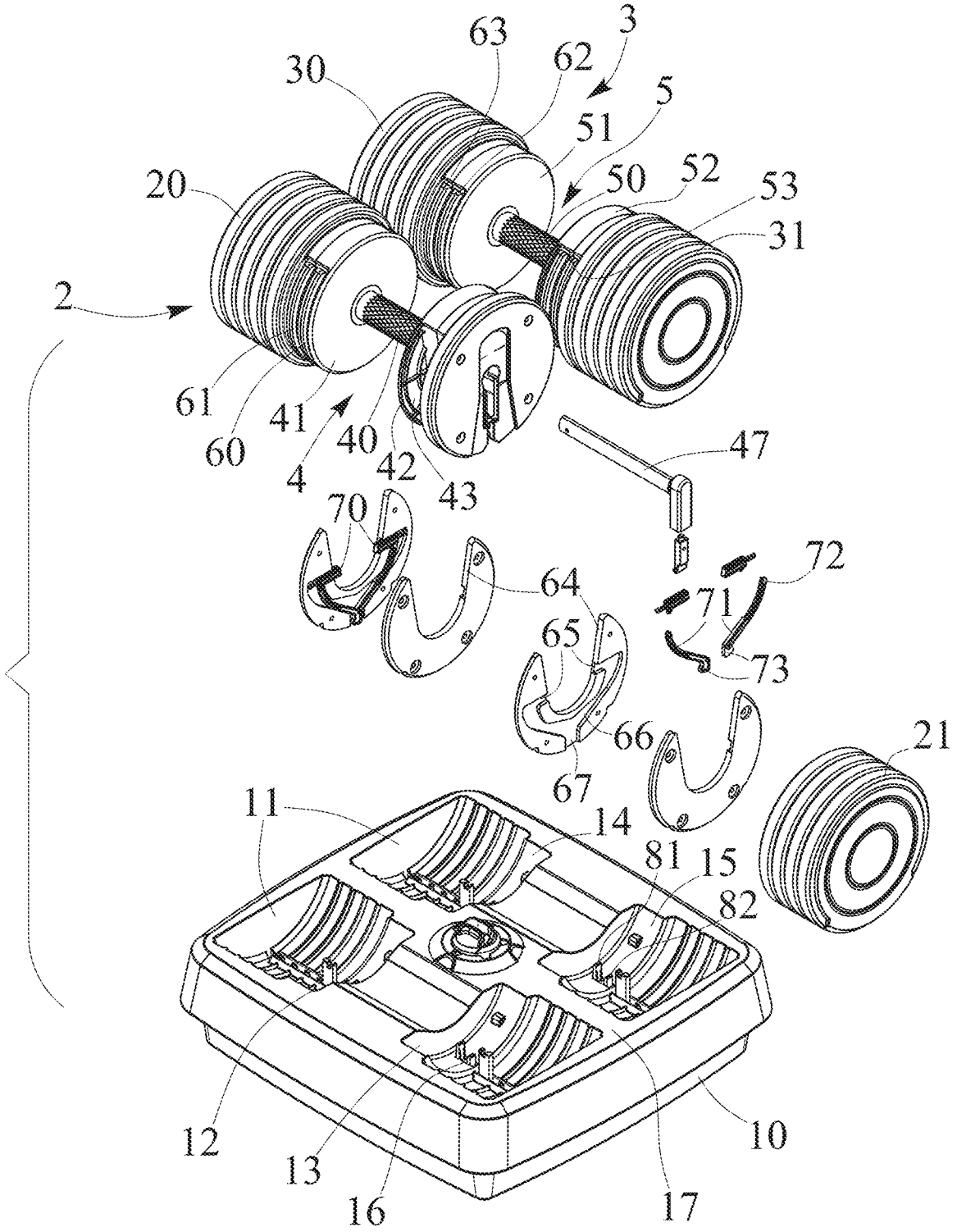
FIG. 2 is a partial exploded view of the adjustable dumbbell.
Figure 3:
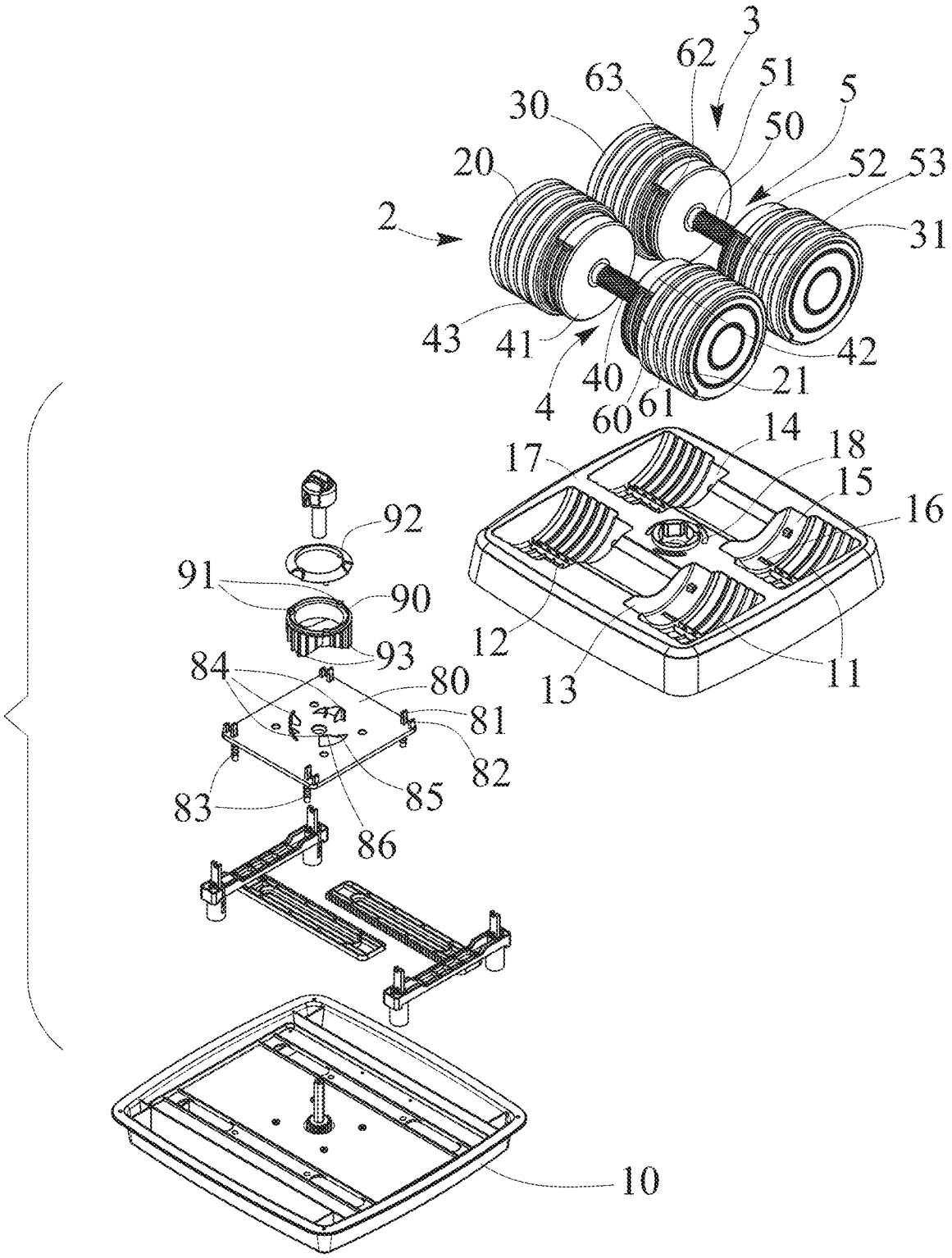
FIG. 3 is another partial exploded view of the adjustable dumbbell.
Figure 4:
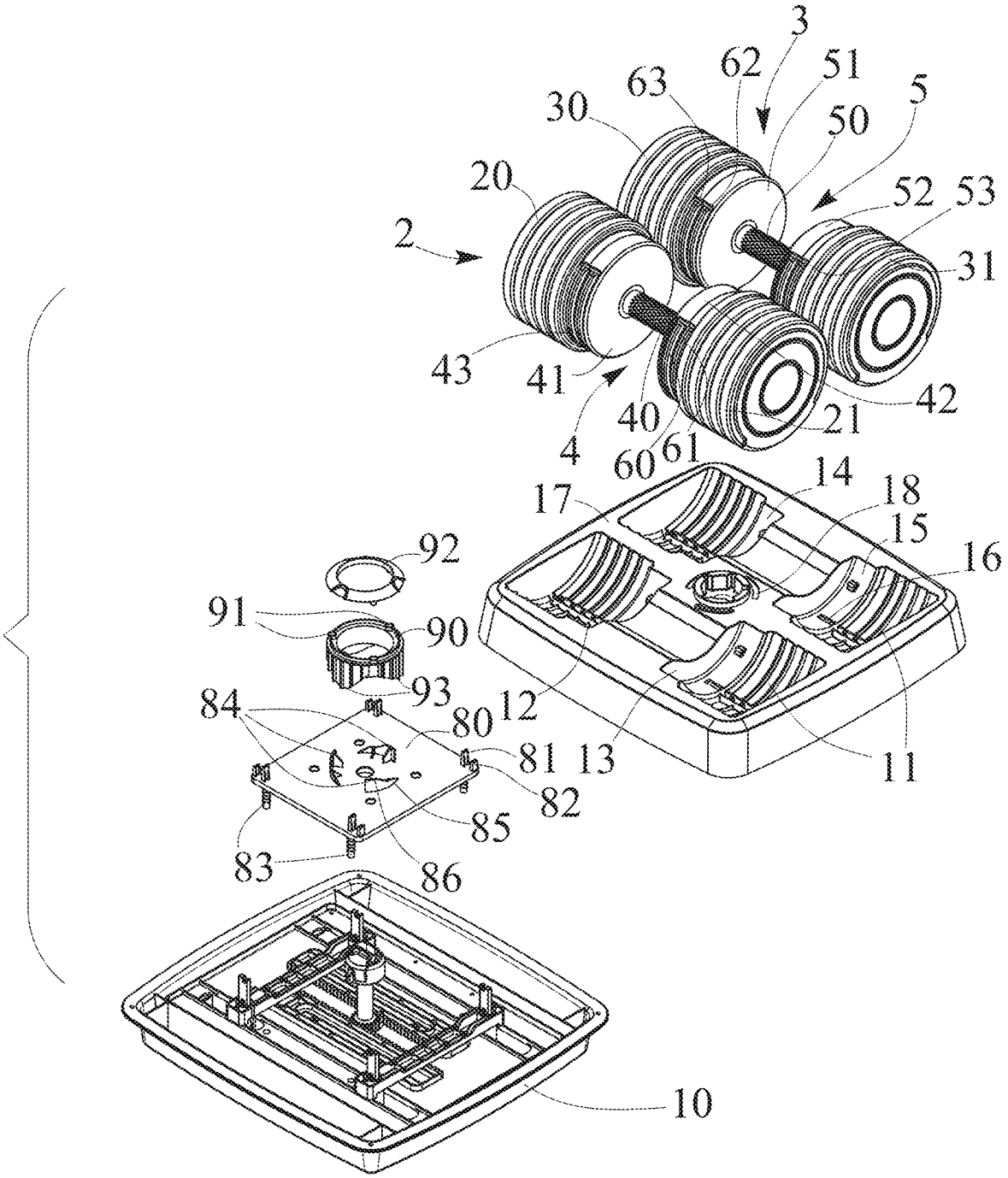
FIG. 4 is a further partial exploded view of the adjustable dumbbell.
Figure 5:
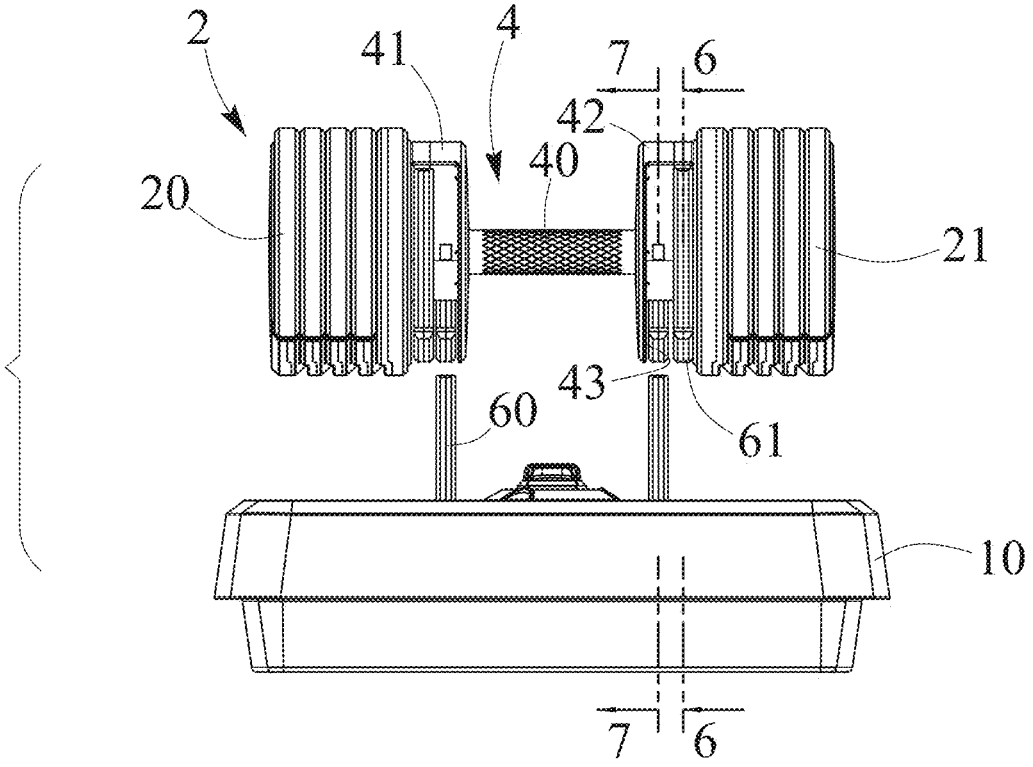
FIG. 5 is a side plan schematic view of the adjustable dumbbell, in which the dumbbell is disengaged or separated from the lower supporting base or receptacle.

Referring to the drawings, and initially to FIGS. 1-4, an adjustable exercise device, such as an adjustable barbell, kettle bell, or dumbbell in accordance with the present invention comprises a supporting base or receptacle 10 including one or more (such as four) compartments or depressions or recesses 11 formed therein for selectively receiving or engaging with four groups of weights 20, 21, 31, such as weight plates or members or elements or weight rings of two dumbbells 2, 3 or first and second dumbbells 2, 3, and including one or more (such as four) seats or depressions 12, 13, 14, 15 formed or provided in the receptacle 10 and arranged or located between the recesses 11 of the receptacle 10 respectively, and/or disposed and arranged or located beside and communicating with the recesses 11 of the receptacle 10 respectively, and/or formed and arranged or located beside the four groups of the weight rings 20, 21, 30, 31, best shown in FIGS. 2 and 3. The receptacle 10 includes one or more (such as four) passages 16 formed therein and communicating with the depressions 12, 13, 14, 15 of the receptacle 10 respectively.

The dumbbells 2, 3 each include a handle mechanism 4, 5 to be disposed and engaged between the groups of the weight rings 20, 21; 30, 31, the first and the second handle mechanisms 4, 5 each include a central handle bar 40, 50 having one or more (such as two) end members or end housings 41, 42; 51, 52 disposed or extended radially and outwardly from the end portions thereof respectively. The housings 41, 42; 51, 52 each include a space or chamber 43, 53 formed therein (FIGS. 1-3) for receiving or engaging with one or more (such as two) further weight rings or weight plates or members or elements, such as first and second weight members 60, 61 and first and second weight elements 62, 63, the housings 41, 42; 51, 52 each include a frame or protrusion 44 (FIGS. 6, 7) extended into the chamber 43, 53 thereof respectively, and one or more (such as two) lock notches 45 formed in the respective protrusion 44.

One or more (such as four) latches 47 (FIG. 2) are slidably received or engaged in the handle bars 40, 50 and extendible out of the housings 4:1, 42; 51, 52 and engageable with the weight rings 20, 21; 30, 31, for selectively and detachably or changeably anchoring or retaining or positioning or coupling a required or predetermined number of the weight rings 20, 21; 30, 31, to the housings 41, 42; 51, 52 and the handle bars 40, 50 of the handle mechanism 4, 5. The engagement of the latches 47 with the weight rings 20, 21; 30, 31 is typical and is not related to the present invention and will not be described in further details.

Figure 6:
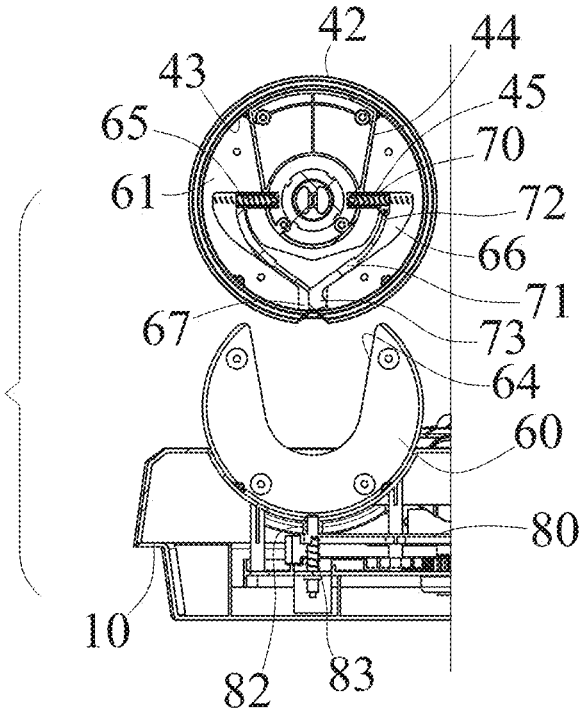
FIG. 6 is a partial cross sectional view of the adjustable dumbbell, taken along lines 6-6 of FIG. 5.
Figure 7:
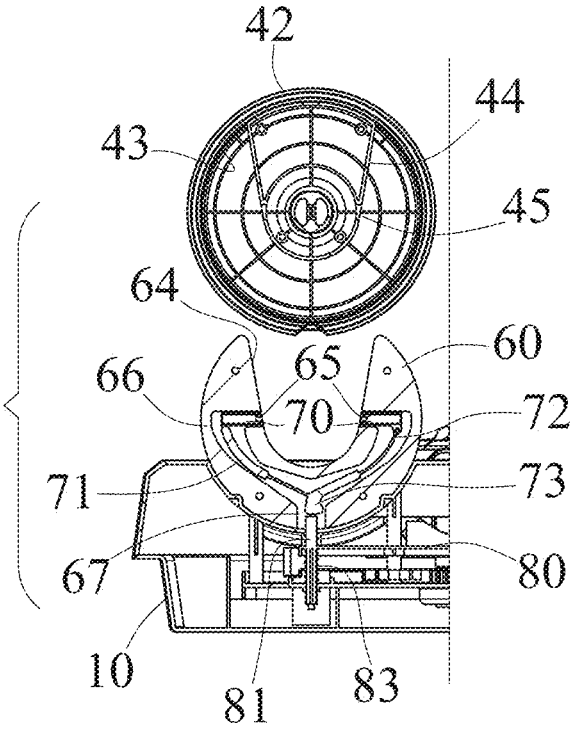
FIG. 7 is a partial cross sectional view of the adjustable dumbbell, taken along lines 7-7 of FIG. 5.

As shown in FIGS. 2 and 6-7, the weight members 60, 61 and the weight elements 62, 63 each include a cavity or notch or space 64 formed therein, such as formed in the middle or intermediate portion thereof, and each include one or more (such as two) channels or grooves 65 formed therein and communicating with the space 64 of the weight members 60, 61 and the weight elements 62, 63 respectively, and each include one or more (such as two) chambers or compartments 66 formed therein and communicating with the grooves 65 respectively, and the compartments 66 of each of the weight members 60, 61 and the weight elements 62, 63 are intersected or communicating with each other at a middle or intermediate central hole or opening 67.

A pair of spring biased latches or tongues or catches 70 are slidably received or engaged in the grooves 65 of the weight members 60, 61 and the weight elements 62, 63 respectively, and biased and forced to be extended or moved into the space 64 of the weight members 60, 61 and the weight elements 62, 63 respectively, and two levers or arms 71 are slidably received or engaged in the compartments 66 of the weight members 60, 61 and the weight elements 62, 63 respectively, and the arms 71 each include one or first end portion 72 pivotally or rotatably connected or coupled to the spring biased catches 70 for pulling or moving the catches 70 into the grooves 65 of the weight members 60, 61 and the weight elements 62, 63 respectively (FIG. 7), and for disengaging the catches 70 from the space 64 of the weight members 60, 61 and the weight elements 62, 63 respectively. The arms 71 each include an other or second end portion 73 extended or located or engaged in the opening 67 of the weight members 60, 61 and the weight elements 62, 63 respectively.

As shown in FIG. 7, when the other or second end portions 73 of the arms 71 are forced or moved upwardly into the compartments 66 of the weight members 60, 61 and the weight elements 62, 63, the arms 71 are arranged to force or move the catches 70 into the grooves 65 of the weight members 60, 61 and the weight elements 62, 63 respectively. On the contrary, as shown in FIG. 6, when the other or second end portions 73 of the arms 71 are released or are not forced to move upwardly into the compartments 66 of the weight members 60, 61 and the weight elements 62, 63, the spring biased catches 70 may be biased and forced to move out of the grooves 65 and into the space 64 of the weight members 60, 61 and the weight elements 62, 63 respectively.

As shown in FIGS. 3-4, 6-7, and 9-11, a plate or carrier 80 is slidably received or engaged in the receptacle 10, and includes one or more (such as four) poles 81 and one or more (such as four) studs 82 extended upwardly from the carrier 80 and extendible upwardly through the passages 16 and into the depressions 12, 13, 14, 15 of the receptacle 10 respectively for contacting or engaging with the other or second end portions 73 of the arms 71 of the weight members 60, 61 and the weight elements 62, 63 respectively, and one or more spring biasing members 83 are disposed or provided in the receptacle 10 and engaged with the carrier 80 for biasing and forcing the poles 8:1 and the studs 82 to move into the depressions 12, 13, 14, 15 of the receptacle 10 respectively, in which it is preferable that the poles 81 are higher than the studs 82, The carrier 80 includes one or more (such as three) protrusions or bulges or cam members 84 extended upwardly from the carrier 80 and preferably arranged in a circle, and the cam members 84 each include one or more (such as two) steps or seats 85, 86 formed or provided thereon.

Another cam member or actuator 90 is pivotally or rotatably received or engaged in the receptacle 10, and contactable or engageable with the cam members 84 of the carrier 80. For example, as shown in FIG. 3, the receptacle 10 includes an upper plate or panel 17 having the recesses 11 and the depressions 12, 13, 14, 15 and the passages 16 formed therein, and having one or more (such as three) curved channels or grooves or slots 18 formed therein, and the actuator 90 includes one or more (such as three) protrusions or projections 91 extended upwardly therefrom and slidably received or engaged in the slots 18 of the upper panel 17 of the receptacle 10 for limiting and guiding the actuator 90 to pivot or rotate relative to the receptacle 10, and to contact or engage with the cam members 84 of the carrier 80. A knob 92 may be attached or mounted or secured or coupled to the projections 91 for anchoring or retaining or positioning the actuator 90 to the receptacle 10, and for pivoting or rotating the actuator 90 relative to the receptacle 10. The actuator 90 includes one or more (such as three) cams or protuberances 93 for contacting or engaging with the seats 85, 86 of the cam members 84 of the carrier 80 (FIGS. 12-14).

Figure 8:
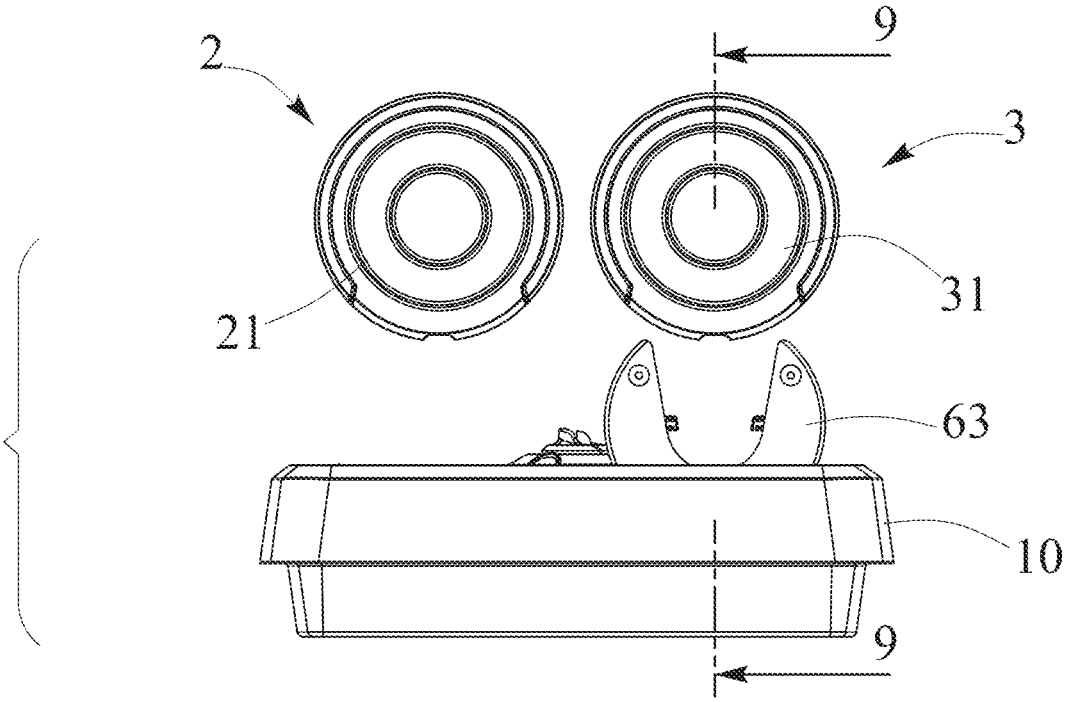
FIG. 8 is a front plan schematic view of the adjustable dumbbell, in which the dumbbells are disengaged or separated from the lower supporting base or receptacle.
Figure 9:
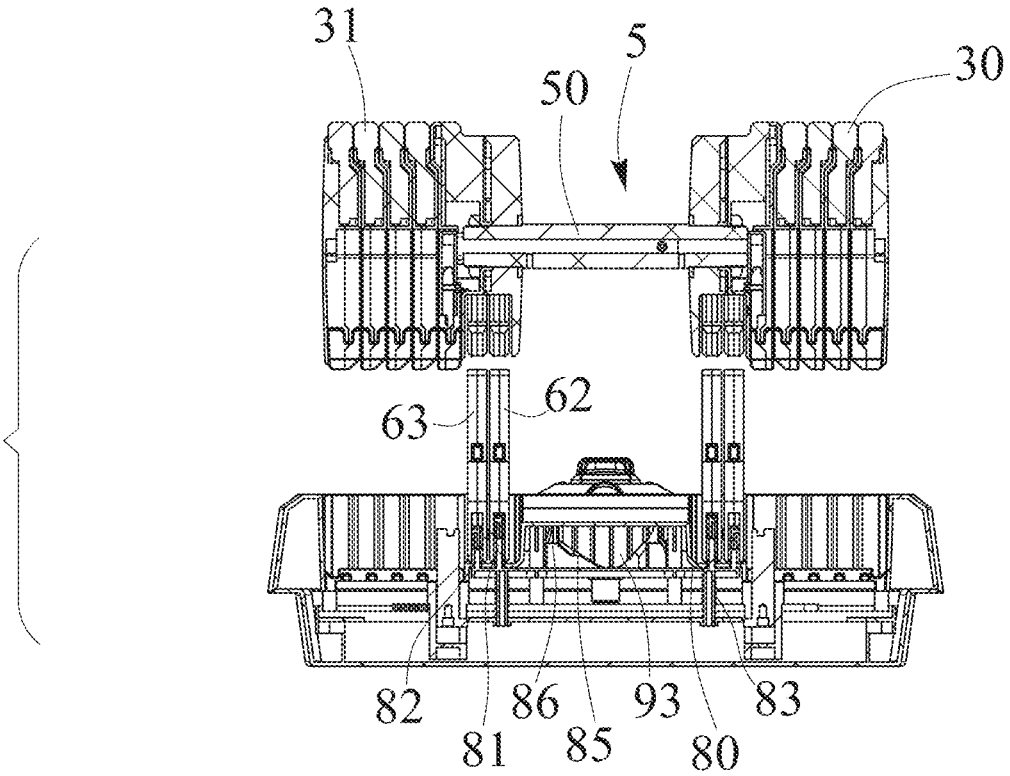
FIG. 9 is a partial cross sectional view of the adjustable dumbbell, taken along lines 9-9 of FIG. 8.
Figure 12:
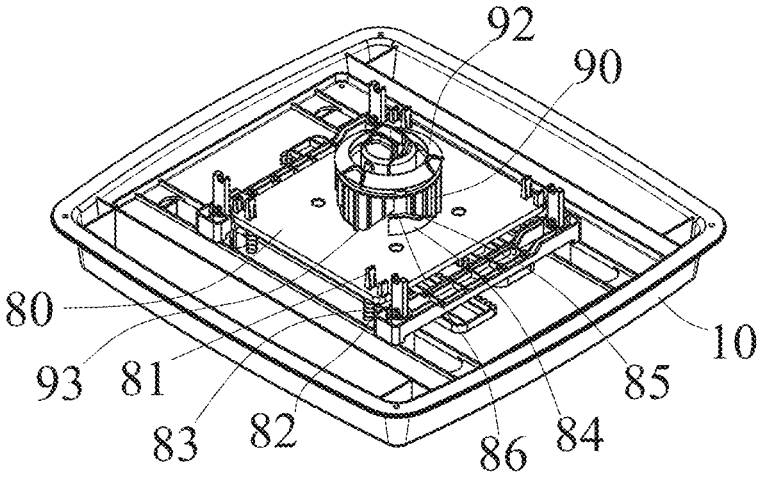
FIG. 12 is a partial perspective view of the adjustable dumbbell.

In operation, as shown in FIGS. 8-9 and 12, when the protuberances 93 of the actuator 90 are disengaged or separated from the cam members 84, the poles 81 and the studs 82 may be biased and forced to move upwardly to engage with the other or second end portions 73 of the arms 71 of the weight members 60, 61 and the weight elements 62, 63 respectively, and to force or move the catches 70 into the grooves 65 and offset from the space 64 of the weight members 60, 61 and the weight elements 62, 63 respectively. At this moment, as shown in FIG. 7, when the catches 70 are forced to move into the grooves 65 and offset from the space 64 of the weight members 60, 61 and the weight elements 62, 63, the catches 70 are disengaged or separated from the protrusions 44 of the housings 41, 42; 51, 52, such that the weight members 60, 61 and the weight elements 62, 63 may not be engaged with and attached to the housings 41, 42; 51, 52 of the handle mechanisms 4, 5 (FIG. 9).

Figure 10:
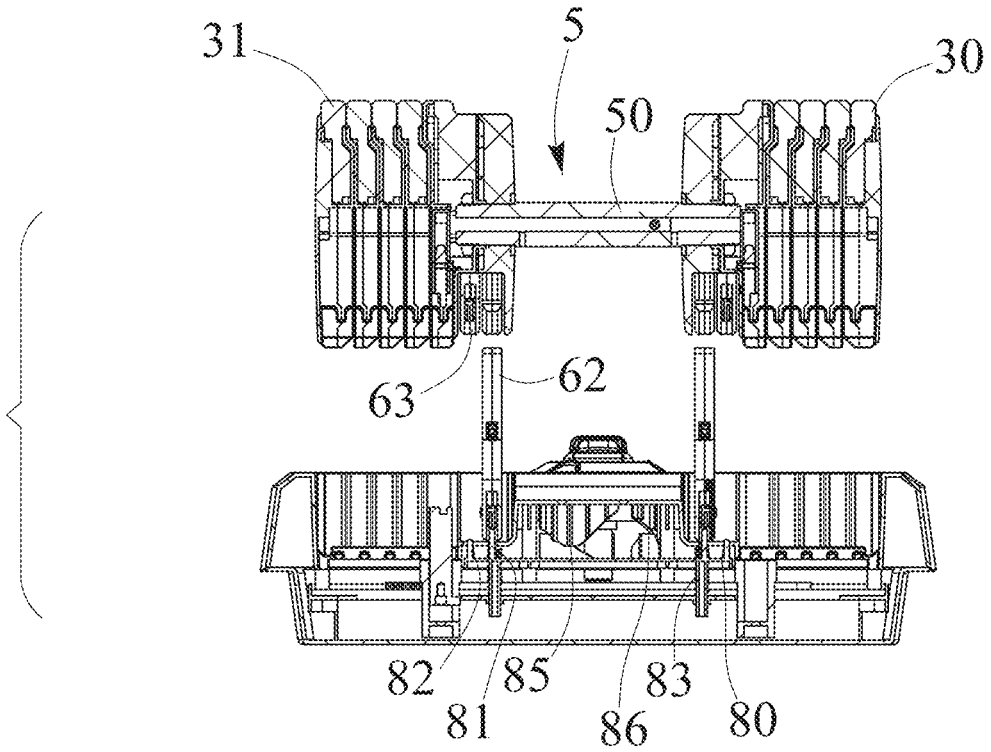
FIGS. 10, 11 are partial cross sectional views similar to FIG. 9, illustrating the operation of the adjustable dumbbell assembly.
Figure 11:
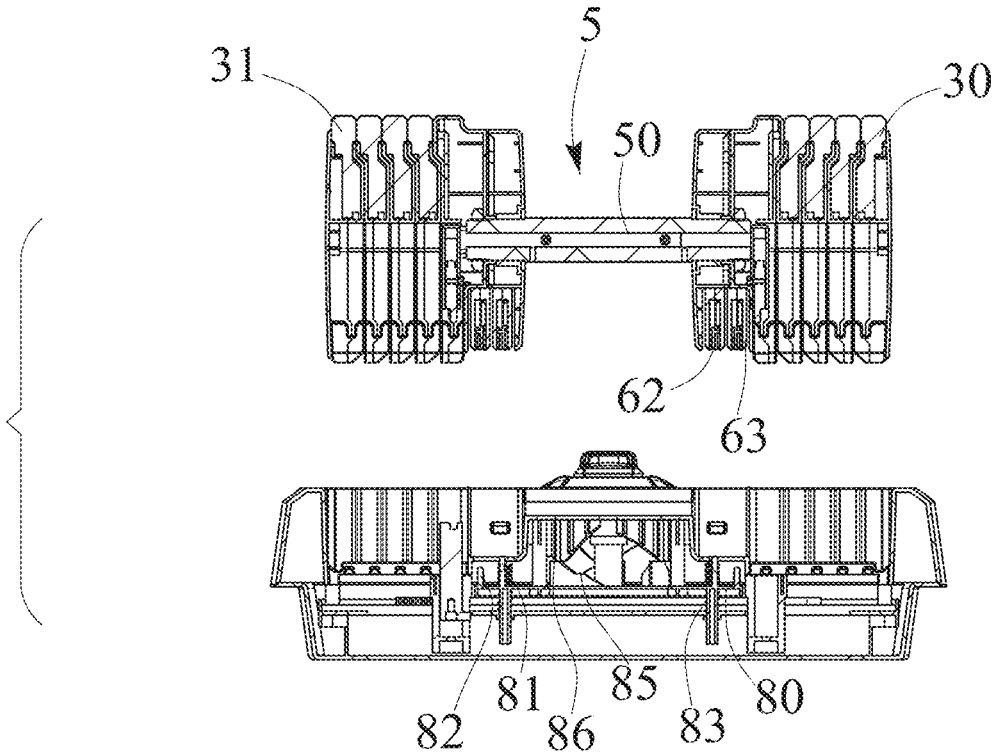
Figure 13:
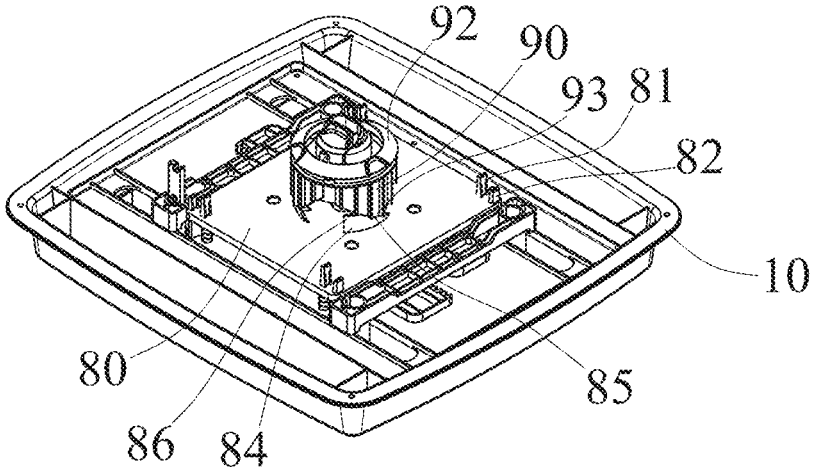
FIGS. 13, 14 are further partial perspective views similar to FIG. 12, illustrating the operation of the adjustable dumbbell assembly.
Figure 14:
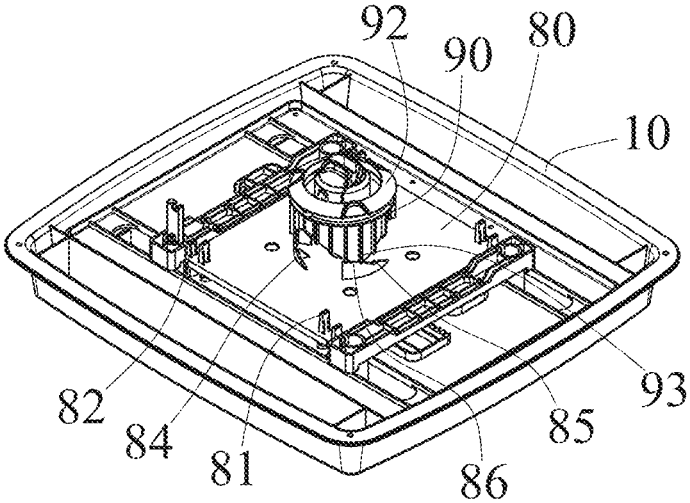

As shown in FIGS. 10 and 13, when the protuberances 93 of the actuator 90 are forced to contact or engage with the cam members 84 of the carrier 80, such as engage with the first seats 85 of the cam members 84, the carrier 80 may be moved downwardly to disengage or separate the studs 82 from the weight members 61 and the weight elements 63, and thus allows the weight members 61 and the weight elements 63 to be attached or mounted or secured or coupled to the housings 41, 42; 51, 52 of the handle mechanisms 4, 5 (FIG. 10). As shown in FIGS. 11 and 14, when the protuberances 93 of the actuator 90 are forced to contact or engage with the cam members 84 of the carrier 80, such as engage with the second seats 86 of the cam members 84, the carrier 80 may further be moved downwardly to disengage or separate both the poles 81 and the studs 82 from the weight members 60, 61 and the weight elements 62, 63, and thus allows the weight members 60, 61 and the weight elements 62, 63 to be attached or mounted or secured or coupled to the housings 41, 42; 51, 52 of the handle mechanisms 4, 5 (FIG. 11). It is only required to pivot or rotate the actuator 90 relative to the receptacle 10, and to engage with and to actuate the cam members 84 of the carrier 80 to move the carrier 80 downwardly relative to the receptacle 10, and to control the engagement of the poles 81 and the studs 82 with the weight members 60, 61 and the weight elements 62, 63.

Accordingly, the adjustable dumbbell in accordance with the present invention includes an improved structure or configuration for easily and quickly coupling the weight members of the dumbbell together and for preventing the weight members of the adjustable dumbbell from being disengaged or separated from each other, and arranged for allowing the weight or the size or the standard of the weight members or of the adjustable exercise device or the adjustable dumbbell to be suitably increased.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjustable dumbbell comprising:

a receptacle including a first passage formed in said receptacle, a first dumbbell including a first weight ring and a second weight ring supported on said receptacle, a handle mechanism including:

a handle bar having a first housing and a second housing to be coupled to said first and said second weight rings selectively, said first housing including a chamber formed in said first housing, and a protrusion extended into said chamber of said first housing, a first weight member supported on said receptacle and engageable into said chamber of said first housing, said first weight member including a space formed in said first weight member for receiving and engaging with said protrusion of said first housing, two grooves being formed in said first weight member and communicating with said space of said first weight member, two first spring biased catches slidably engaged in said grooves of said first weight member and either extendible into said space of said first weight member or engageable in said grooves of said first weight member, two first arms being engaged in said first weight member and coupled to said first spring biased catches respectively for moving said first spring biased catches into and out of said space of said first weight member, a carrier slidably received and engaged in said receptacle, and including a first pole extended from said carrier and extendible upwardly through said first passage of said receptacle for engaging with said first arms, said carrier including a cam member, at least one spring biasing member disposed in said receptacle and engaged with said carrier for biasing and forcing said first pole to engage with said first arms and to disengage said first spring biased catches from said space of said first weight member, and an actuator engageable with said cam member for moving said carrier downwardly relative to said receptacle, and to control an engagement of said first pole with said first arms.

2. The adjustable dumbbell as claimed in claim 1, wherein said receptacle includes an upper panel, and said actuator is rotatably connected to said receptacle.

3. The adjustable dumbbell as claimed in claim 2, wherein said upper panel of said receptacle includes a slot formed in said upper panel, and said actuator includes a projection engaged in said slot of said upper panel for limiting and guiding said actuator to move relative to said receptacle.

4. The adjustable dumbbell as claimed in claim 3, wherein said receptacle includes a knob secured to said projection for anchoring said actuator to said receptacle.

5. The adjustable dumbbell as claimed in claim 1, wherein a second weight member is supported on said receptacle and engageable into said chamber of said first housing, said second weight member includes a space formed in said second weight member for receiving and engaging with said protrusion of said first housing, two grooves being formed in said second weight member and communicating with said space of said second weight member, two second spring biased catches slidably engaged in said grooves of said second weight member and either extendible into said space of said second weight member or engageable in said grooves of said second weight member, two second arms are engaged in said second weight member and coupled to said second spring biased catches for moving said second spring biased catches into and out of said space of said second weight member, said carrier includes a first stud extended from said carrier and extendible upwardly through said first passage of said receptacle for engaging with said second arms, said first pole is higher than said first stud, said cam member includes a first seat and a second seat, and said actuator is engageable with said first seat and said second seat of said cam member for moving said carrier downwardly relative to said receptacle, and to control an engagement of said first pole and said first stud with said first arms and said second arms.

6. The adjustable dumbbell as claimed in claim 5, wherein said first weight member and said second weight member each include two compartments formed in said first weight member and said second weight member and communicating with said grooves of each of said first weight member and said second weight member for receiving and engaging with said first arms and said second arms respectively.

7. The adjustable dumbbell as claimed in claim 6, wherein said compartments of each of said first weight member and said second weight member are communicating with each other at a middle opening, said first arms and said second arms each include a first end portion connected to said first spring biased catches and said second spring biased catches, and a second end portion engaged in said opening of each of said first weight member and said second weight member.

8. The adjustable dumbbell as claimed in claim 1, wherein said receptacle includes a second passage formed in said receptacle, said carrier includes a second pole extended from said carrier and extendible upwardly through said second passage of said receptacle, said second housing includes a chamber formed in said second housing, and a protrusion extended into said chamber of said second housing, said first dumbbell includes a third weight member supported on said receptacle and engageable into said chamber of said second housing, said third weight member includes a space formed in said third weight member for receiving and engaging with said protrusion of said second housing, two grooves being formed in said third weight member and communicating with said space of said third weight member, two third spring biased catches slidably engaged in said grooves of said third weight member and either extendible into said space of said third weight member or engageable in said grooves of said third weight member, two third arms are engaged in said third weight member and coupled to said third spring biased catches for moving said third spring biased catches into and out of said space of said third weight member.

9. The adjustable dumbbell as claimed in claim 8, wherein said carrier includes a second stud extended from said carrier and extendible upwardly through said second passage of said receptacle, said first dumbbell includes a fourth weight member supported on said receptacle and engageable into said chamber of said second housing, said fourth weight member includes a space formed in said fourth weight member for receiving and engaging with said protrusion of said second housing, two grooves are formed in said fourth weight member and communicating with said space of said fourth weight member, two fourth spring biased catches slidably engaged in said grooves of said fourth weight member and either extendible into said space of said fourth weight member or engageable in said grooves of said fourth weight member, two fourth arms are engaged in said fourth weight member and coupled to said fourth spring biased catches for moving said fourth spring biased catches into and out of said space of said fourth weight member.

10. The adjustable dumbbell as claimed in claim 1 further comprising a second dumbbell including a third weight ring and a fourth weight ring supported on said receptacle, said receptacle including a third passage formed in said receptacle, a second handle mechanism including a handle bar having a third housing and a fourth housing to be coupled to said third and said fourth weight rings selectively, said third and said fourth housings each including a chamber formed in said third and said fourth housings respectively, and a protrusion extended into said chamber of each of said third and said fourth housings respectively, a first weight element supported on said receptacle and engageable into said chamber of said third housing, said first weight element including a space formed in said first weight element for receiving and engaging with said protrusion of said third housing, two grooves being formed in said first weight element and communicating with said space of said first weight element, two fifth spring biased catches slidably engaged in said grooves of said first weight element and either extendible into said space of said first weight element or engageable in said grooves of said first weight element, two fifth arms being engaged in said first weight element and coupled to said fifth spring biased catches for moving said fifth spring biased catches into and out of said space of said first weight element, said carrier including a third pole extended from said carrier and extendible upwardly through said third passage of said receptacle for engaging with said fifth arms.

11. The adjustable dumbbell as claimed in claim 10, wherein a second weight element is supported on said receptacle and engageable into said chamber of said third housing, said second weight element includes a space formed in said second weight element for receiving and engaging with said protrusion of said third housing, two grooves being formed in said second weight element and communicating with said space of said second weight element, two sixth spring biased catches slidably engaged in said grooves of said second weight element and either extendible into said space of said second weight element or engageable in said grooves of said second weight element, two sixth arms are engaged in said second weight element and coupled to said sixth spring biased catches for moving said sixth spring biased catches into and out of said space of said second weight element, said carrier includes a third stud extended from said carrier and extendible upwardly through said third passage of said receptacle for engaging with said sixth arms respectively, said third pole is higher than said third stud.

12. The adjustable dumbbell as claimed in claim 10, wherein said receptacle includes a fourth passage formed in said receptacle, said carrier includes a fourth pole extended from said carrier and extendible upwardly through said fourth passage of said receptacle, said second dumbbell includes a third weight element supported on said receptacle and engageable into said chamber of said fourth housing, said third weight element includes a space formed in said third weight element for receiving and engaging with said protrusion of said fourth housing, two grooves being formed in said third weight element and communicating with said space of said third weight element, two seventh spring biased catches slidably engaged in said grooves of said third weight element and either extendible into said space of said third weight element or engageable in said grooves of said third weight element, two seventh arms are engaged in said third weight element and coupled to said seventh spring biased catches for moving said seventh spring biased catches into and out of said space of said third weight element.

13. The adjustable dumbbell as claimed in claim 12, wherein said second dumbbell includes a fourth weight element supported on said receptacle and engageable into said chamber of said fourth housing, said fourth weight element includes a space formed in said fourth weight element for receiving and engaging with said protrusion of said fourth housing, two grooves are formed in said fourth weight element and communicating with said space of said fourth weight element, two eighth spring biased catches are slidably engaged in said grooves of said fourth weight element and either extendible into said space of said fourth weight element or engageable in said grooves of said fourth weight element, two eighth arms are engaged in said fourth weight element and coupled to said eighth spring biased catches for moving said eighth spring biased catches into and out of said space of said fourth weight element.

14. The adjustable dumbbell as claimed in claim 13, wherein said carrier includes a fourth stud extended from said carrier and extendible upwardly through said fourth passage of said receptacle, said fourth stud is provided for engaging with said eighth arms, said fourth pole is higher than said fourth stud.

* * * * *